US005622063A

United States Patent [19]

Slowinski

[11] Patent Number: 5,622,063

[45] Date of Patent: Apr. 22, 1997

[54] STAR-SHAPED PRECIOUS STONE MOUNTING

[75] Inventor: Christopher Slowinski, Bellerose, N.Y.

[73] Assignee: Christopher Designs Inc., New York, N.Y.

[21] Appl. No.: 506,727

[22] Filed: Jul. 26, 1995

[51] Int. Cl.[6] ..... A44C 17/02

[52] U.S. Cl. ..... 63/28; 63/32

[58] Field of Search ..... 63/2, 26, 27, 28, 63/32

[56] References Cited

U.S. PATENT DOCUMENTS 775,030 11/1904 Fairbrother, Jr. ..... 63/28

2,907,187 10/1959 Karp et al. ..... 63/28

4,914,930 4/1990 Bielka ..... 63/28

5,072,601 12/1991 Slowinski ..... 63/28

*Primary Examiner*—Kien T. Nguyen

*Attorney, Agent, or Firm*—Ostrolenk, Faber, Gerb & Soffen, LLP

[57] ABSTRACT

A jewelry piece includes a mounting for precious stones, the mounting being multi-pointed, star-shaped. The star-shaped mounting defines a plurality of N compartments, and in each compartment there is mounted a respective precious stone. The precious stones substantially fill the entire star-shaped mounting. The appearance is of an integral, single stone which is star-shaped.

17 Claims, 4 Drawing Sheets

FIG. 4A
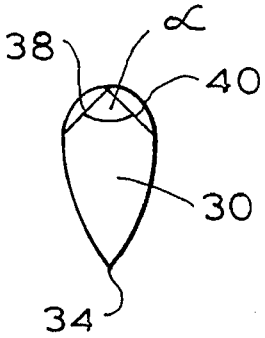
FIG. 4C
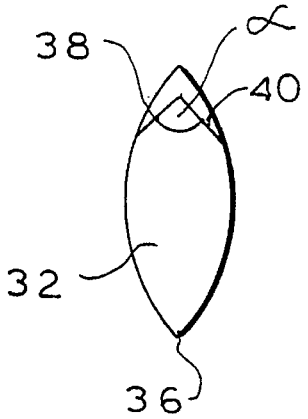
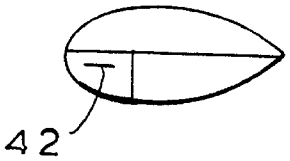
FIG. 4B
FIG. 6A
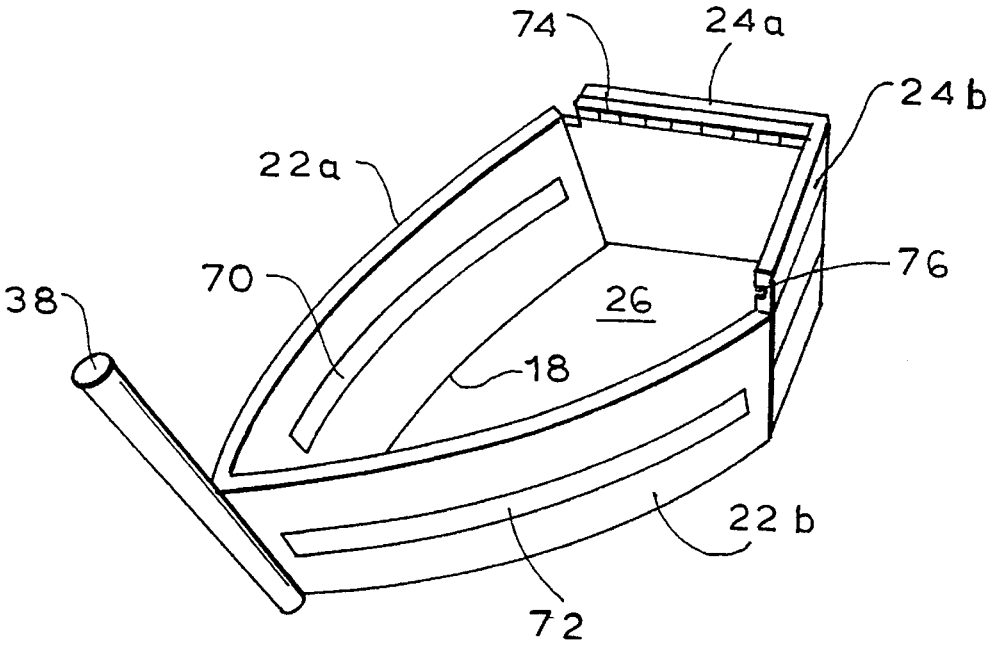

STAR-SHAPED PRECIOUS STONE MOUNTING

BACKGROUND OF THE INVENTION

The present invention relates to jewelry and, more particularly, to jewelry pieces incorporating precious and/or semi-precious stones arranged in a star-shaped mounting.

FIG. 1 illustrates a prior art star-shaped, multi-pointed precious or semi-precious stone 10. Typically, the star-shaped precious stone 10 is cut from a larger sized raw stone 12 which can be round as indicated in FIG. 1 or square, etc. Such a stone is then mounted in a gold or other precious metal mounting and sold as a pin, pendant, earrings, etc.

There are certain drawbacks to the manner in which the star-shaped precious stone is formed and mounted in accordance with the prior art. First, a larger size stone is needed to create the star-shaped stone 10 of the prior art. These types of stones are more expensive. Second, a considerable amount of labor is required to cut the raw stone 12 to give it the illustrated star-shape. The stone cutting process is not only difficult and labor intensive; but it often results in the breakage of an expensive stone.

The present inventor has recognized that it would be useful, competitively advantageous, and challenging to provide the trade with jewelry pieces incorporating precious stones and/or semi-precious stones which have the appearance of the star-shaped prior art stones, but which are in actuality fabricated of smaller, discrete stones which are arranged together to convey and closely resemble the prior art star-shaped stones.

SUMMARY OF THE INVENTION

Accordingly, it is an object of the present invention to provide a jewelry piece which incorporates a plurality of precious and/or semi-precious stones which are arranged in a star-shape, the jewelry piece being considerably less expensive than similar prior art jewelry pieces.

It is a further object of the invention to provide a simple and inexpensive method for fabricating star-shaped stones.

It is yet another object of the present invention to provide a stone mounting which is suited to have set in it stones which together convey the appearance of an integral, single piece star-shaped stone.

The foregoing and other objects of the invention are realized by a jewelry piece which incorporates a mounting for precious stones, which mounting is generally star-shaped and includes a plurality of compartments each shaped to receive one respective stone. The mounting is so arranged that when the individual stones are set in its individual compartments, the overall setting conveys the impression of a single stone in that the stones have specially formed surfaces which allow the stones to closely abut one another without showing mounting hardware, e.g. prongs and the like that are typically used to hold precious stones in place.

Other features and advantages of the present invention will become apparent from the following description of the invention which refers to the accompanying drawings.

BRIEF DESCRIPTION OF THE DRAWINGS

FIG. 4A is a top-view of a pear-shaped stone which is specially cut to fit in the novel stone mounting of the present invention.

FIG. 4B is a side view of the stone of FIG. 4A.

FIG. 4C is similar to FIG. 4A except that it shows a marquis stone.

FIGS. 6A, 6B and 6C depict perspectively one of the precious stone compartments of the mounting shown in FIG. 2.

DETAILED DESCRIPTION OF EMBODIMENTS OF THE INVENTION

Figure 1:
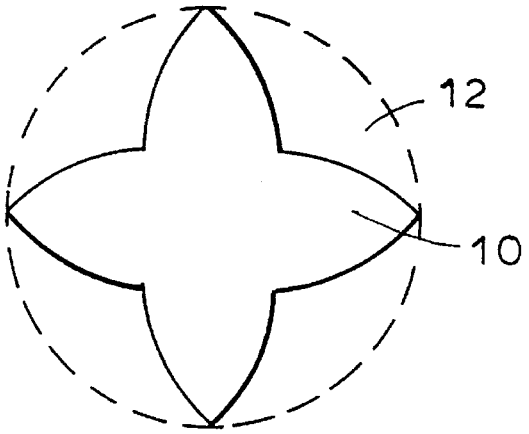
FIG. 1 PRIOR ART
FIG. 1 depicts the prior art star-shaped stone.
Figure 2:
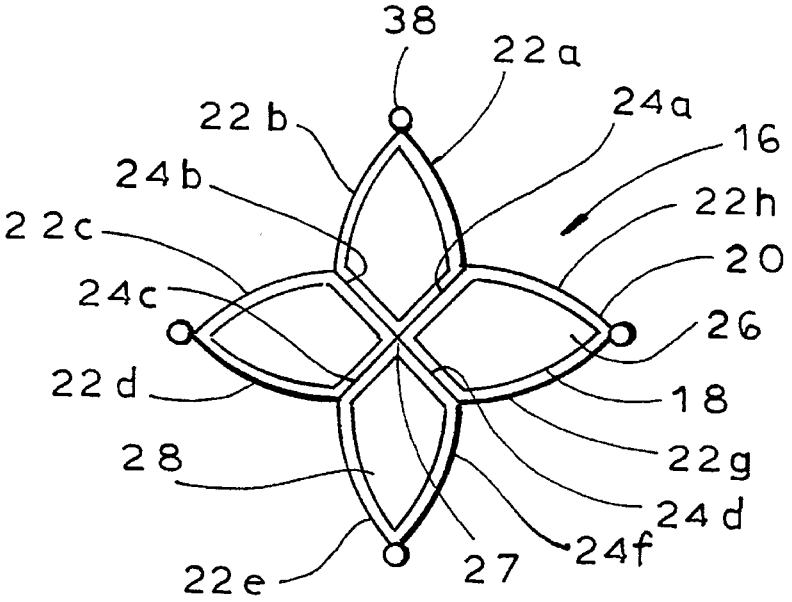
FIG. 2 shows a four-pointed, star-shaped mounting of the jewelry piece of the present invention.

With reference to FIG. 2, The star-shaped mounting 16 of the present invention includes a base or platform 18, whose outer peripheral edge 20 bears an outer peripheral wall 22, which consists of wall segments 22*a*, 22*b*, 22*c*, 22*d*, 22*e*, 22*f*, 22*g* and 22*h*. Each of these wall segments 22*a*–22*g* extends generally perpendicularly to the base 18, i.e. to the plane of the paper on which FIG. 2 is drawn. Generally at the center of the base, there are intermediate stone-partitioning wall segments, i.e. wall segments 24*a*, 24*b*, 24*c* and 24*d*, which extend from the peripheral wall 22 toward the center of the mounting 16. The wall segments 24*a*–24*c* define above the base 18 four precious stone compartments, e.g. compartment 26, for mounting therein a precious stone. In FIG. 2, each compartment is generally pear-shaped, but it can have other shapes, e.g. a shape to accommodate a marquis stone. Each compartment 26 has also defined in its base portion an aperture 28 through which light is admitted to add sparkle to the precious stone and/or for purposes of introducing a cleansing fluid.

Figure 3:
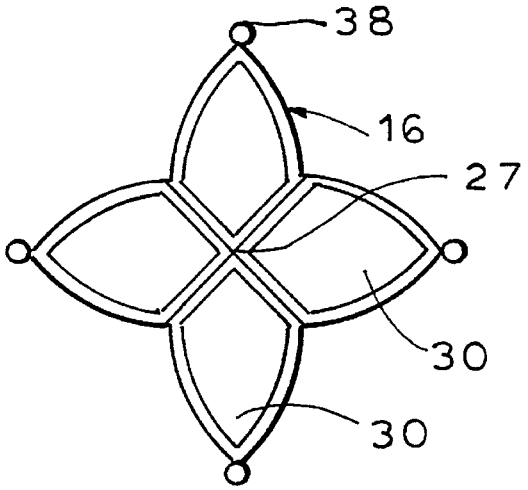
FIG. 3 shows the mounting of FIG. 2 with precious stones mounted therein.

Referring now to FIGS. 4A, 4B and 4C, these figures depict, respectively, a per se known pear-shaped stone 30 (FIG. 4A) and a marquis stone 32 (FIG. 4C). These stones have, respectively, tips 34 and 36 which are intended to be engaged by the retaining prongs 38 shown in FIG. 2. That is, as shown in FIG. 3, the pear-shaped compartments 26 are each designed to receive one of the pear-shaped stones 30 of FIG. 4A. Each of the stones 30 is inserted by having its tip 34 located beneath the prong and then pushed down.

Figure 5A:
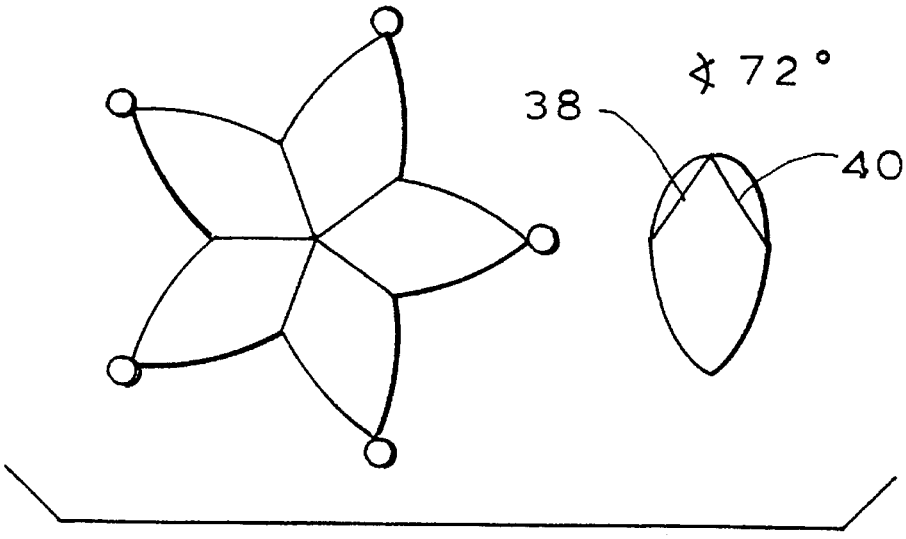
FIGS. 5A and 5B respectively show five-pointed and six-pointed, star-shaped precious stone mountings.
Figure 5B:
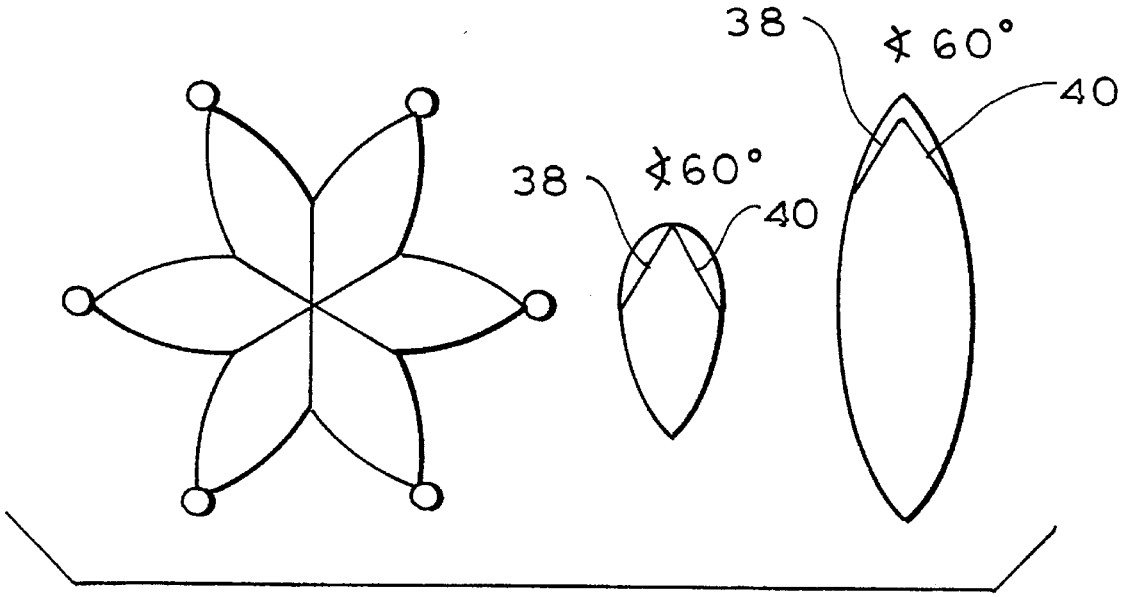

In this connection, note that the pear-shaped stone 30 is specially processed in accordance with the present invention, so that the end thereof which lies opposite to the tip 34 is further cut to define a pair of intersecting faces 38 and 40. These faces define an intersecting angle $\alpha$ which, in the embodiment of FIGS. 2 and 3, measures approximately 90°. This 90° angle is specifically selected so that the mating surfaces 38 and 40 could snugly engage the aforementioned stone partitioning walls 24*a*–24*d* of the compartments 26. The compartments 26 meet at the center 27 of mounting 16, and are so arranged that when the stones 30 are mounted therein, the stones also meet at the center 27 with their faces 38 and 40 abutting tightly (FIG. 5A). Each stone extends from the center 27 radially outwardly as seen in FIG. 3.

In the present inventor's prior U.S. Pat. No. 5,072,601 and in the prior art patents cited therein, namely U.S. Pat. Nos. 802,267; 1,100,252; 2,138,340; 2,141,363; 2,304,036; 3,964,680; 4,728,238; 4,738,240; 4,800,738, and 4,813,246; French Patent Nos. 832824 and 2570259; United Kingdom Patent Nos. 465772 and 5103052, there are described various method for mounting precious and/or semi-precious stone in an invisible manner, i.e. closely abutting one another. Such a mounting permits stones which are disposed on opposite sides of a wall to lie flush against one another, so as to convey the appearance of a continuous integral precious stone, i.e. diamond, emerald, sapphire etc. The contents of each of the aforementioned U.S. and foreign patents is incorporated by reference herein.

In accordance with the present invention and as illustrated in FIG. 4B, the pear-shaped diamond of 4A is provided with a cutout 42 which enables the mating walls of the pear-shaped diamond 32 to bite into the partitioning walls 24*a* and 24*b* in a manner described in the present inventor's aforementioned U.S. Pat. No. 5,072,601.

Thus, the present invention also discloses the concept of adapting prior art precious stone mounting schemes which have been applied in accordance with the conventional wisdom only to diamonds which are mounted in straight rows or channels, to the star-shaped arrangement of the present invention.

FIG. 5A shows a diamond or precious stone setting which has generally all of the features of the setting shown in FIGS. 2 and 3, except that it is a five-pointed, star-shaped mounting. Therefore, the angle $\alpha$ in this case is approximately 72°. In FIG. 5A, there is depicted a six-pointed, star-shaped mounting which can use precious or semi-precious stones which have been cut to define mating surfaces which meet at an angle $\alpha$ of approximately 60°.

The present invention can be implemented with diamonds or other stones of any color e.g. emeralds, sapphires, etc. having a pear shape, a marquis shape and/or even circular stones which have been cut to have defined in them the mating surfaces 38 and 40 described above.

In the present patent specification, the term "star-shape" includes a flower shape, i.e. the pointed ends of the mounting does not have to be pointed. It can be round.

FIG. 6A shows perspectively one of the compartments 26 of the mounting of FIG. 2. The compartment which is depicted is the one which is defined by peripheral wall segments 22*a* and 22*b* and which has stone-partitioning wall segments 24*a* and 24*b*. The prong 38 is bent generally in a direction toward the wall segments 24*a* and 24*b*, after a stone is inserted into the compartment 26. Note the cutouts 70 and 72 in the wall segments 22*a* and 22*b*. These cutouts can be larger than shown. They serve to admit more light and also to use less gold in the mounting. The bottom is open. The base 18 is nothing other than the bottom of the wall 22. In this perspective drawing, a first cutout 74 and a second cutout or channel 76 appear in the stone-partitioning wall segments 24*a* and 24*b*, respectively.

Figure 6B:
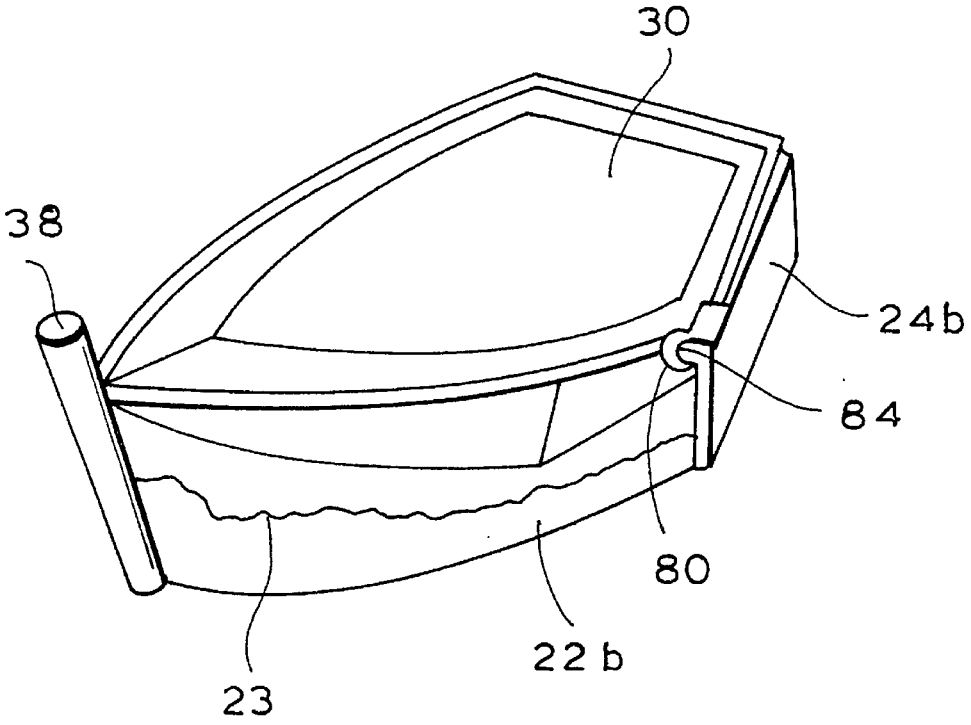
Figure 6C:
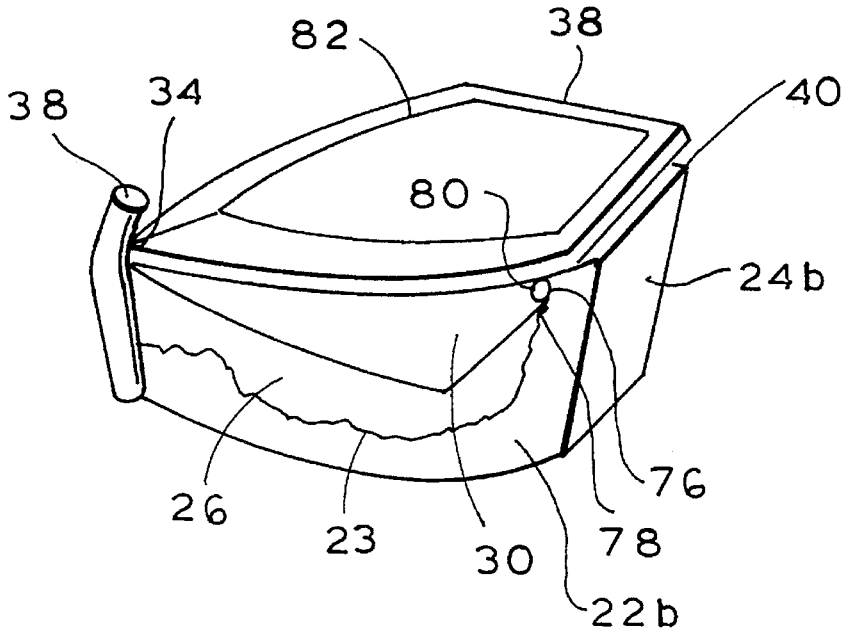

In FIG. 6C, the pear-shaped, precious stone 30 is shown mounted in the compartment 26. The wall segment 22*b* is partially cut away as indicated by the broken line 23 to reveal the precious stone 30 in the compartment 26 with it tip 34 bearing with pressure against the prong 38 so that a supporting edge 78 defined by a cutout 80 in the stone engages and lies in the channels 74, 76 (FIG. 6A), assuring that the stone 30 is securely mounted in the compartment. The circumscribing line 82 defines the highest projection of the stone 30. Note that the straight surfaces 38 and 40 of the stone (see FIG. 4A) partially extend over the wall segments 24*a* and 24*b* so that stones of adjacent compartments abut one another without showing the mounting hardware underneath.

FIG. 6B is generally similar to FIG. 6C, except that it shows the stone-partitioning wall 24*b* with a projection 84 which fits into the cutout 80 of the stone 30.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A jewelry piece comprising:

a mounting including a peripheral circumferential edge and a peripheral wall arranged in a star-shaped configuration along the edge and defining N stone compartments, where N is a positive integer greater than 2; and a plurality of N jewelry stones substantially filling the compartments defined by the peripheral wall, each of the stones having first and second mating surfaces and each of the first and second mating surfaces mating with corresponding mating surfaces of adjacent ones of said stones, the peripheral wall of the mounting defining a center of the mounting and the plurality of jewelry stones being so arranged that each of the stones extends from the center radially outwardly in a manner which simulates the appearance of a single, star-shaped stone, the mounting further including stone-partitioning walls extend inwardly from the peripheral wall to define the compartments, the stone-partitioning walls engaging and supporting the stones and being disposed below the stones in a manner such that the stone-partitioning walls are not visible.

2. The jewelry piece of claim 1, wherein the jewelry stones are diamonds.

3. The jewelry piece of claim 1, wherein said stones comprise semi-precious stones.

4. The jewelry piece of claim 1, wherein N equals 4.

5. The jewelry piece of claim 1, wherein N equals 5.

6. The jewelry piece of claim 1, wherein N equals 6.

7. The jewelry piece of claim 1, wherein the mating surfaces intersect at an angle of between 60° and 90°.

8. The jewelry piece of claim 7, in which the angle is about 90°.

9. The jewelry piece of claim 7, in which the angle is about 72°.

10. The jewelry piece of claim 7, in which the angle is about 60°.

11. The jewelry piece of claim 7, in which the jewelry stones are invisibly mounted.

12. The jewelry piece of claim 1, in which the mating surfaces are provided with cutouts to engage and to be secured at the stone-partitioning walls.

13. The jewelry piece of claim 12, in which N is a number between 4 and 8.

14. The jewelry piece of claim 13, in which each compartment is generally pear-shaped.

15. The jewelry piece of claim 14, in which each of the compartments is generally marquis-shaped.

16. The jewelry piece of claim 13, including cutouts in the peripheral wall to admit light and use less material in the mounting.

17. The jewelry piece of claim 1, including a respective prong for each of the compartments, each of the stones being mounted to bear against the prong and to be thereby pressed against the stone-partitioning walls.

* * * * *